US006366071B1

(12) United States Patent
Yu

(10) Patent No.: US 6,366,071 B1
(45) Date of Patent: Apr. 2, 2002

(54) LOW VOLTAGE SUPPLY BANDGAP REFERENCE CIRCUIT USING PTAT AND PTVBE CURRENT SOURCE

(75) Inventor: Hung Chang Yu, Taipei (TW)

(73) Assignee: Taiwan Semiconductor Manufacturing Company, Hsin-chu (TW)

( * ) Notice: Subject to any disclaimer, the term of this patent is extended or adjusted under 35 U.S.C. 154(b) by 0 days.

(21) Appl. No.: 09/902,893

(22) Filed: Jul. 12, 2001

(51) Int. Cl.[7] ..... G05F 3/20
(52) U.S. Cl. ..... 323/316
(58) Field of Search ..... 323/313, 314, 323/315, 316

(56) References Cited

U.S. PATENT DOCUMENTS

| | | | | |
|---|---|---|---|---|
| 4,603,291 A | | 7/1986 | Nelson | 323/315 |
| 4,808,908 A | | 2/1989 | Lewis et al. | 323/313 |
| 5,132,556 A | | 7/1992 | Cheng | 307/296.7 |
| 5,444,219 A | | 8/1995 | Kelly | 219/505 |
| 5,646,518 A | | 7/1997 | Lakshmikumar et al. | 323/316 |
| 5,818,292 A | | 10/1998 | Slemmer | 327/539 |
| 6,016,051 A | * | 1/2000 | Can | 323/314 |

* cited by examiner

*Primary Examiner*—Shawn Riley
(74) *Attorney, Agent, or Firm*—George O. Saile; Stephen B. Ackerman

(57) ABSTRACT

A bandgap reference circuit comprising two NMOS transistors, where the first NMOS transistor is driven by a PTAT current source and the second transistor is driven by a PTVBE current source. The PTAT current (IPTAT) and PTVBE current (IPTVBE) are summed in a resistive circuit RX to generate the bandgap or sub-bandgap reference voltage. The IPTAT and IPTVBE currents are generated simultaneously in separate current sources and each of these currents is then used to gate the first and second transistor, respectively. The magnitude of the bandgap or sub-bandgap reference voltage is determined by the ratio of RX and a resistive circuit in the PTVBE current source. By requiring only two transistors, in parallel, coupled to resistive circuit RX the supply voltage required for all circuits is lower than heretofore possible.

20 Claims, 4 Drawing Sheets

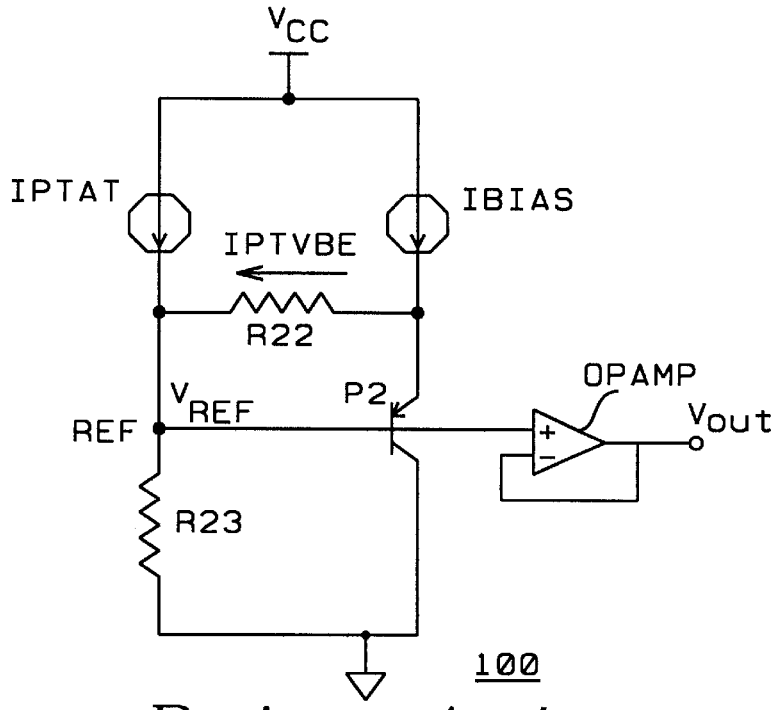
FIG. 1 – Prior Art
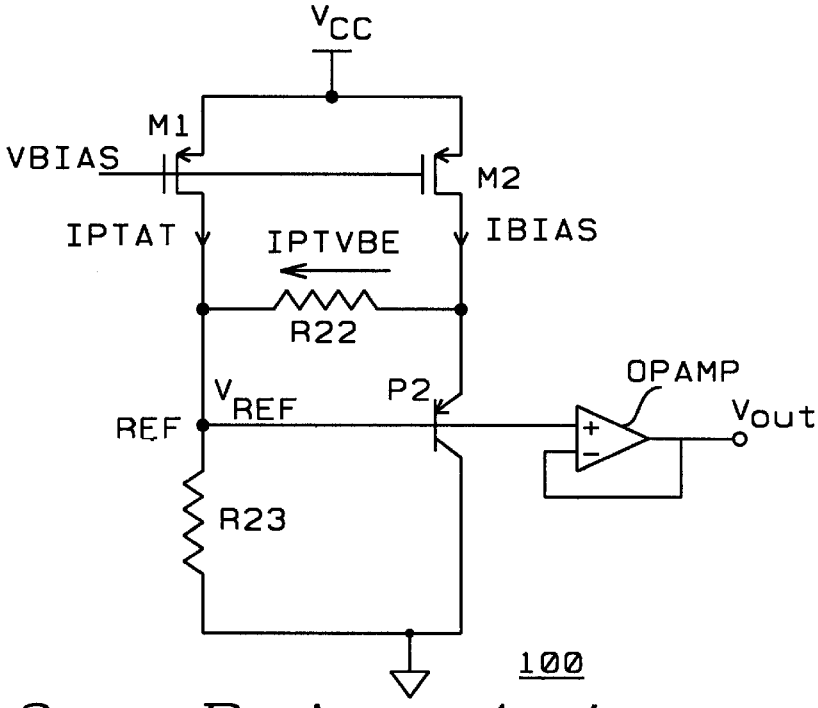
FIG. 2 – Prior Art

LOW VOLTAGE SUPPLY BANDGAP REFERENCE CIRCUIT USING PTAT AND PTVBE CURRENT SOURCE

BACKGROUND OF THE INVENTION

1. Field of the Invention

The invention relates to an integrated circuit (IC), and more particularly to low voltage bandgap and sub-bandgap reference circuits.

2. Description of the Related Art

Usually the bandgap reference circuit provides a stable and zero temperature coefficient reference voltage by using PTAT voltage. The PTAT circuit uses delta VBE, i.e. the difference between two base-emitter voltages, VBE1 and VBE2. Thus $$\Delta VBE = VBE1 - VBE2 = VPTAT \quad (1)$$

$$\Delta VBE = \frac{kT}{q} \times \ln\left(\frac{J1}{J2}\right) \quad (2)$$

where k is Boltzmann's constant,

T is absolute temperature in degree Kelvin, q is electron charge,

J1 and J2 are current densities through the emitter of bipolar transistors T1 and T2.

Reference is made to U.S. Pat. No. 6,016,051 (Can), filed Jan. 18, 2000, FIG. 2 and a description and explanation of that circuit therein. The circuit 200 of that FIG. 2 is reproduced herein as FIG. 1 (prior art), circuit 100. The circuit 100 is an example of using a PTAT circuit to generate a bandgap and sub-bandgap voltage. However, circuit 100 can hardly operate under a supply voltage VCC as low as 1 volt when used in the conventional process of 0.25 um or 0.18 um (um=micrometer) if the desired VREF≅|Vth|, where Vth is the threshold voltage of PMOS or NMOS transistors. The reason can be explained in FIG. 2 (prior art), circuit 100. This circuit substitutes generic current sources IPTAT and IBIAS with transistors M1 and M2 whose gates are driven by current source IBIAS. In FIG. 2 the $V_{SD}$ of PMOS M2 must be greater than $$V_{SG} - |Vth| \text{ of } M2.$$

Where $V_{SD}$ is the source-drain voltage of M2, and $V_{SG}$ is the source-gate voltage of M2. Thus $$V_{SD} \geqq V_{SG} - |Vth|$$

where |Vth| is the threshold voltage of PMOS M2.

For circuit 100 to work, the following condition must be achieved.

$$V_{SD,M2} + VBE + VREF < VCC$$

However, if the desired VREF≅0.5 volt, and VBE≅0.5 volt, then usually $$V_{SD,M2} + VBE + VREF > 1 \text{ volt}$$

That is, circuit 100 cannot work at VCC as low as 1 volt.

Using this delta VBE, a correct circuit structure and an appropriate ratio between two resistors, not only a bandgap reference voltage but also a sub-bandgap reference voltage can be generated as will be demonstrated hereinafter. The bandgap reference circuit in accordance with one embodiment of the present invention can operate not only with CMOS technology but also under wide range of power supplies, even under low VCC of about 1V.

Other U.S. Patents, in addition to above referenced U.S. Pat. No. 6,016,051, which relate to the subject at hand are:

U.S. Pat. No. 5,818,292 (Slemmer), U.S. Pat. No. 5,132,556 (Cheng), and U.S. Pat. No. 4,808,908 (Lewis et al.) disclose bandgap reference circuits.

U.S. Pat. No. 5,646,518 (Lakshmikumar et al.), U.S. Pat. No. 5,444,219 (Kelly), and U.S. Pat. No. 4,603,291 (Nelson) show patents otherwise related to the subject.

SUMMARY OF THE INVENTION

It is an object of the present invention to provide circuits and methods to provide a bandgap and sup-bandgap reference voltage requiring a voltage supply no greater than the voltage drop of a transistor plus the generated bandgap reference voltage.

It is another object of the present invention to provide a bandgap reference voltage which produces a stable and zero temperature coefficient reference voltage.

It is another object of the present invention to utilize the ratio of two resistive circuits or resistive means to generate the bandgap and sup-bandgap reference voltage.

These and many other objects have been achieved by utilizing a new circuit structure where the sum of the PTAT current (IPTAT) and PTVBE current (IPTVBE) are summed in a resistive circuit or resistive means RX to generate the bandgap or sub-bandgap reference voltage. The IPTAT and IPTVBE currents are generated simultaneously in separate current source circuits and each of these currents is then used to gate a transistor, i.e., two transistor are used in the circuit of the preferred embodiment of the present invention. The current of these two transistors is then summed in RX, thus generating the bandgap or sub-bandgap reference voltage. The magnitude of the bandgap or sub-bandgap reference voltage is determined by the ratio of RX and a resistive circuit in the PTVBE current source.

These and many other objects and advantages of the present invention will be readily apparent to one skilled in the art to which the invention pertains from a perusal of the claims, the appended drawings, and the following detailed description of the preferred embodiments.

BRIEF DESCRIPTION OF THE DRAWINGS

FIG. 1 is a schematic diagram of a bandgap reference circuit of the prior art.

FIG. 2 is a circuit diagram of FIG. 1.

In the figures like parts are identified by like numerals.

DESCRIPTION OF THE PREFERRED EMBODIMENT

Figure 3:
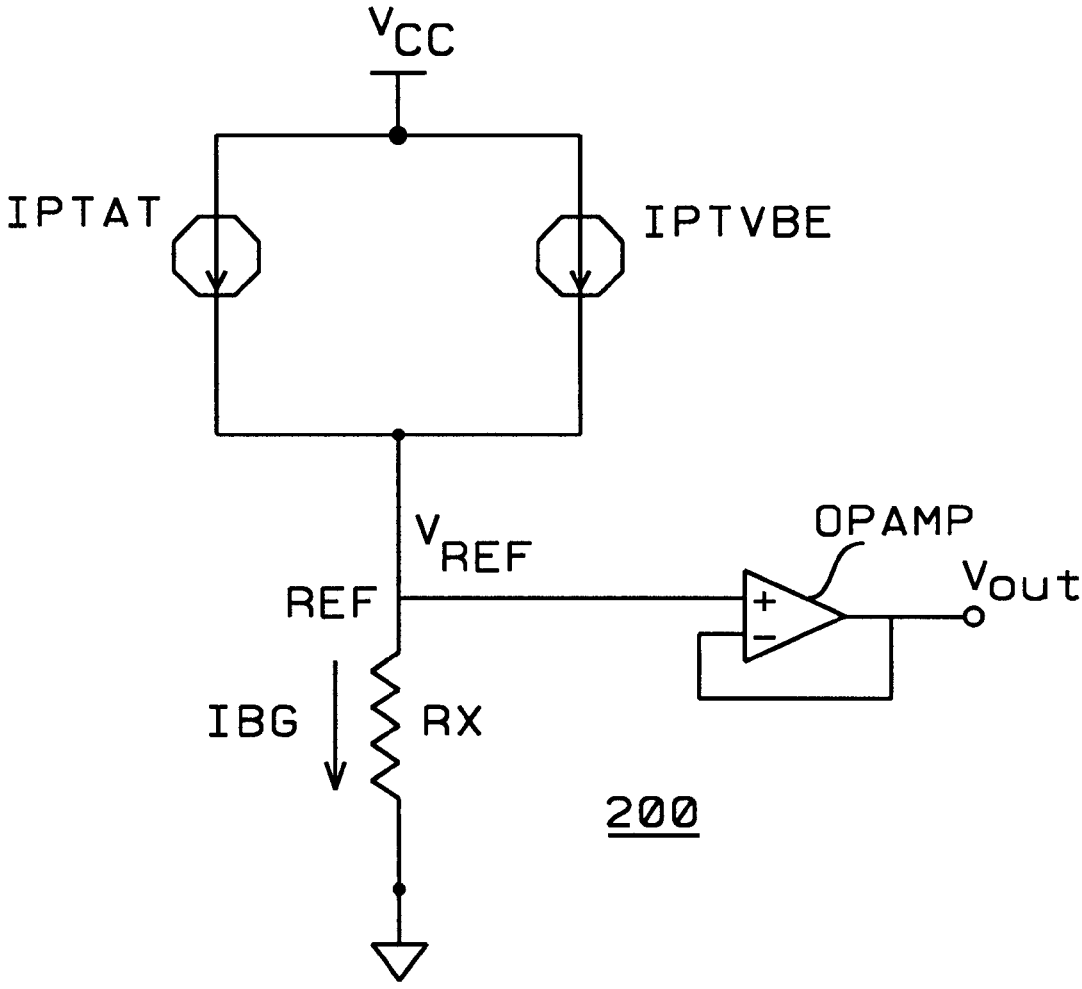
FIG. 3 is a schematic diagram of a bandgap reference circuit of the preferred embodiment of the present invention.
Figure 4:
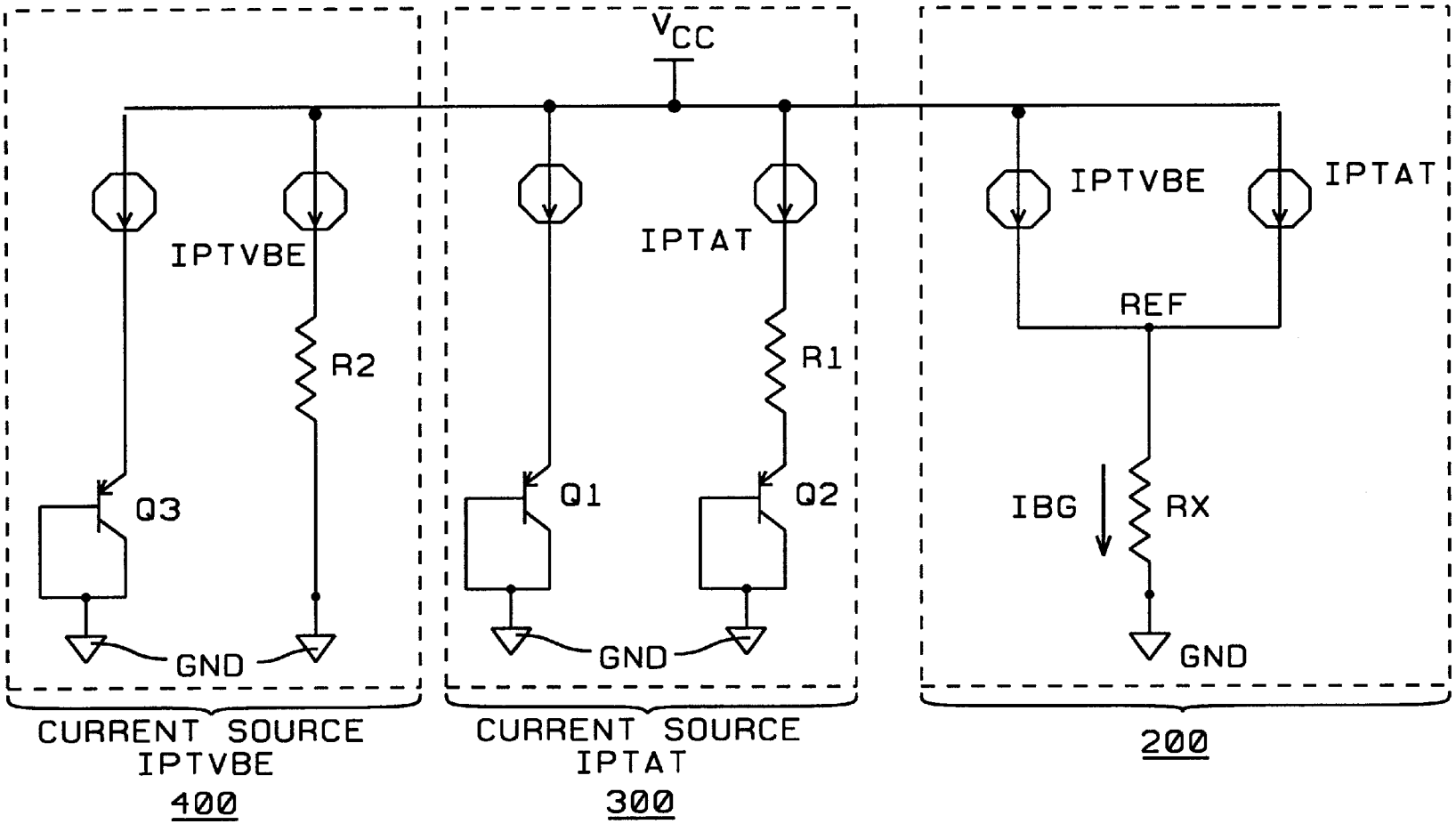
FIG. 4 is a schematic diagram of a bandgap reference circuit of the preferred embodiment of the present invention showing in addition and schematically the IPTVBE and IPTAT current sources.

The bandgap reference circuit 200 in accordance with the embodiment of the present invention is illustrated in FIG. 3 and FIG. 4. FIG. 4 in addition to circuit 200 also shows circuits 300 and 400, where circuit 300 is the current source IPTAT and circuit 400 is the current source IPTVBE for circuit 200. In FIG. 4, IPTAT is the current source whose current density is proportional to the absolute temperature. The base-emitter voltage of bipolar transistor Q3, of circuit 400, is VBE. The operation of this circuit can be described by the following equations.

$$IBG=I1+I2 \tag{3}$$

$$I1=IPTAT \tag{4}$$

$$I2=\frac{VBE}{R2}=IPTVBE \tag{5}$$

IPTVBE is the current proportional to VBE.

Besides, refer to the circuit 300 in FIG. 4, VPTAT is equal to ΔVBE, and $$IPTAT=\frac{\Delta VBE}{R1}=\frac{VPTAT}{R1} \tag{6}$$

Thus the bandgap reference current can be derived as $$\begin{aligned} IBG &= IPTAT+\frac{VBE}{R2} \\ &= \frac{VPTAT}{R1}+\frac{VBE}{R2} \\ &= \frac{1}{R2}\left(VBE+\frac{R2}{R1}VPTAT\right) \end{aligned} \tag{7}$$

$$\text{Let}\quad VBG=VBE+\frac{R2}{R1}VPTAT \tag{8}$$

$$\text{Then}\quad IBG=\frac{VBG}{R2} \tag{9}$$

Thus, the desired reference voltage VREF can be derived.

$$\begin{aligned} VREF &= IBG\times RX \\ &= \frac{RX}{R2}VBG \end{aligned} \tag{10}$$

Circuits 300 and 400 individually are known in the prior art and are, therefore, not described. In particular circuit 300 is shown and described in the referenced U.S. Pat. No. 6,016,051 as circuit 401 of FIG. 4.

Figure 5:
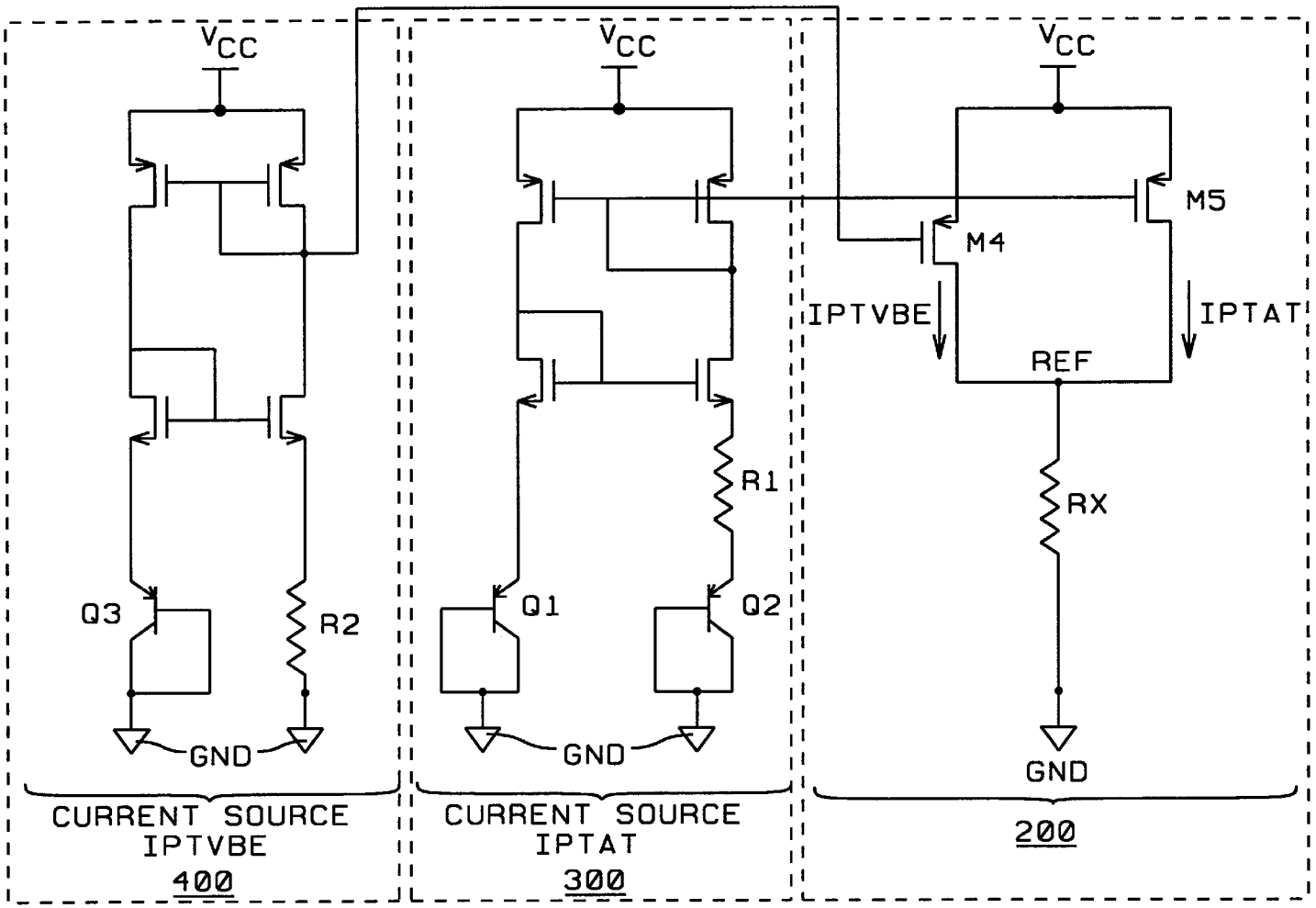
FIG. 5 is a circuit diagram of FIG. 4.

FIG. 5 illustrates the proposed voltage control circuit structure utilizing bandgap reference circuit 200, and circuits 300 and 400.

The bandgap reference circuit 200 comprises a proportional to absolute temperature (PTAT) current source, which provides a PTAT current IPTAT, and a proportional to base to emitter voltage (PTVBE) current source, which provides a PTVBE current IPTVBE and which are coupled to a junction REF. Current is supplied to circuit 200 by voltage supply VCC. The PTAT current source, comprising transistor M5, is operably controlled by a first current source 300 which provides a current proportional to the ratio of the difference of the base to emitter voltage (ΔVBE) of a first transistor Q1 and a second transistor Q2 coupled to a first resistive means R1. The PTVBE current source, comprising transistor M4, is operably controlled by a second current source 400 which provides a current proportional to the ratio of a base to emitter voltage (VBE) of a third transistor Q3 and a second resistive means R2.

Still referring to FIG. 5, a resistive means RX is coupled between junction REF and a reference potential labeled GND. Resistive means RX is configured to receive PTAT current IPTAT and PTVBE current IPTVBE and in accordance therewith provides a reference voltage VREF at junction REF which is essentially constant over temperature and which is proportional to a silicon bandgap voltage. More particularly reference voltage VREF is proportional to a the bandgap voltage of silicon (VBG) multiplied by the ratio of resistive means RX and second resistive means R2 of second current source 400.

The voltage control circuit is operable with a voltage supply providing a voltage VCC equal to the sum of voltage VREF and a voltage drop across the PTAT current source transistor M5 such that:

$$V_{SD,M5}+VREF=VCC$$

whereas the prior art required a voltage VCC equal to:

$$V_{SD,M5}+VBE+VREF$$

which is larger than: $V_{SD,M5}$+VREF.

From equation (10) it can be seen that:

$$\text{when}\ \frac{RX}{R2}>1\ \text{ then }\ VREF>VBG \tag{11}$$

$$\text{when}\ \frac{RX}{R2}=1\ \text{ then }\ VREF=VBG \tag{12}$$

$$\text{when}\ \frac{RX}{R2}<1\ \text{ then }\ VREF<VBG \tag{13}$$

It follows from equations (11) through (13) that any reference voltage can be generated depending on the RX/R2 ratio, but equation (13) indicates specifically that a sub-bandgap reference voltage is generated when RX/R2<1.

The voltage control circuit may further comprise a buffer circuit coupled to junction REF (typically an operational amplifier) as illustrated in FIG. 3 by way of example.

Inventor's method of providing a bandgap reference circuit comprises these steps:

1) Supplying a proportional to absolute temperature (PTAT) current;
2) Supplying a proportional to base to emitter voltage (PTVBE) current;
3) Operably controlling the PTAT current by a first current, where the first current provides a current proportional to the ratio of the difference of the base to emitter voltage (ΔVBE) of a first transistor and a second transistor, where the second transistor is coupled to a first resistive means (R1);
4) Operably controlling the PTVBE current by a second current, where the second current provides a current proportional to the ratio of a base to emitter voltage (VBE) of a third transistor and a second resistive means (R2);
5) Receiving of the PTAT current and of the PTVBE current by a resistive means RX, and in accordance therewith providing a reference voltage VREF which is essentially constant over temperature and which is proportional to a silicon bandgap voltage, where the reference voltage VREF is proportional to the bandgap voltage of silicon (VBG) multiplied by the ratio of the resistive means RX and the second resistive means;
6) Operating the voltage control circuit with a supply voltage at least equal to the sum of the voltage VREF and a voltage drop across the PTAT current source.

In step 1) the PTAT current may be generated by a first transistor M5 as illustrated in FIG. 5.

In step 2) the PTVBE current may be generated by a second transistor M4 as illustrated in FIG. 5.

In summary the advantages of the present invention are that bandgap reference voltages and sub-bandgap reference voltages can be generated using a supply voltage which is lower than the supply voltage of the prior art. The supply voltage VCC of the present invention is $$V_{SD,M5}+VREF=VCC$$

whereas the prior art requires a voltage VCC equal to:

$$V_{SD,M5}+VBE+VREF$$

While the invention has been particularly shown and described with reference to the preferred embodiments thereof, it will be understood by those skilled in the art that various changes in form and details may be made without departing from the spirit and scope of the invention.

What is claimed is:

1. A voltage control circuit including a bandgap reference circuit, comprising:

a proportional to absolute temperature (PTAT) current source which provides a PTAT current;

a proportional to base to emitter voltage (PTVBE) current source which provides a PTVBE current; said PTAT current source and said PTVBE current source coupled to a junction REF;

said PTAT current source operably controlled by a first current source providing a current proportional to the ratio of the difference of the base to emitter voltage (ΔVBE) of a first transistor and a second transistor coupled to a first resistive means in said first current source;

said PTVBE current source operably controlled by a second current source providing a current proportional to the ratio of a base to emitter voltage (VBE) of a third transistor and a second resistive means in said second current source;

a resistive means RX coupled between said junction REF and a reference potential, said resistive means RX configured to receive said PTAT current and said PTVBE current and in accordance therewith provide a reference voltage VREF at said junction REF which is essentially constant over temperature and which is proportional to a silicon bandgap voltage, said reference voltage VREF proportional to a said bandgap voltage of silicon (VBG) multiplied by the ratio of said resistive means RX and said second resistive means in said second current source; and said voltage control circuit operable with a voltage supply providing a voltage equal to the sum of said voltage VREF and a voltage drop across said PTAT current source.

2. The voltage control circuit of claim 1, wherein the ratio of said resistive means RX and said second resistive means is such that the reference voltage VREF is greater than or equal to said silicon bandgap voltage.

3. The voltage control circuit of claim 1, wherein the ratio of said resistive means RX and said second resistive means is such that the reference voltage VREF is less than or equal to said silicon bandgap voltage.

4. The voltage control circuit of claim 1, further comprising a buffer circuit coupled to said junction REF.

5. The voltage control circuit of claim 4, wherein said buffer circuit comprises an operational amplifier.

6. A method of providing a bandgap reference circuit, comprising the steps of:

supplying a proportional to absolute temperature (PTAT) current;

supplying a proportional to base to emitter voltage (PTVBE) current;

operably controlling said PTAT current by a first current, said first current providing a current proportional to the ratio of the difference of the base to emitter voltage (ΔVBE) of a first transistor and a second transistor coupled to a first resistive means;

operably controlling said PTVBE current by a second current, said second current providing a current proportional to the ratio of a base to emitter voltage (VBE) of a third transistor and a second resistive means;

receiving of said PTAT current and of said PTVBE current by a resistive means RX, and in accordance therewith providing a reference voltage VREF which is essentially constant over temperature and which is proportional to a silicon bandgap voltage, said reference voltage VREF proportional to said bandgap voltage of silicon (VBG) multiplied by the ratio of said resistive means RX and said second resistive means; and operating said voltage control circuit with a supply voltage at least equal to the sum of said voltage VREF and a voltage drop across said PTAT current source.

7. The method of claim 6, wherein the ratio of said resistive means RX and said second resistive means is such that the reference voltage VREF is greater than or equal to said silicon bandgap voltage.

8. The method of claim 6, wherein the ratio of said resistive means RX and said second resistive means is such that the reference voltage VREF is less than or equal to said silicon bandgap voltage.

9. The method of claim 6, further comprising a buffer circuit coupled to said junction REF.

10. The method of claim 9, wherein said buffer circuit comprises an operational amplifier.

11. A voltage control circuit including a bandgap reference circuit, comprising:

a proportional to absolute temperature (PTAT) current source which provides a PTAT current, said PTAT current source comprising a first transistor connected between a voltage supply and a node REF;

a proportional to base to emitter voltage (PTVBE) current source which provides a PTVBE current; said PTVBE current source comprising a second transistor, said second transistor connected between said voltage supply and said node REF;

said PTAT current source operably controlled by a first current source providing a current proportional to the ratio of the difference of the base to emitter voltage (ΔVBE) of a first transistor and a second transistor, said second transistor coupled to a first resistive means, in said first current source;

said PTVBE current source operably controlled by a second current source providing a current proportional to the ratio of a base to emitter voltage (VBE) of a third transistor and a second resistive means in said second current source;

a resistive means RX coupled between said node REF and a reference potential, said resistive means RX configured to receive said PTAT current and said PTVBE current and in accordance therewith provide a reference voltage VREF at said node REF which is essentially constant over temperature and which is proportional to a silicon bandgap voltage, said reference voltage VREF proportional to a said bandgap voltage of silicon (VBG) multiplied by the ratio of said resistive means RX and said second resistive means in said second current source; and said voltage control circuit operable with a voltage supply providing a voltage equal to the sum of said voltage VREF and a voltage drop across said PTAT current source.

12. The voltage control circuit of claim 11, wherein the ratio of said resistive means RX and said second resistive means is such that the reference voltage VREF is greater than or equal to said silicon bandgap voltage.

13. The voltage control circuit of claim 11, wherein the ratio of said resistive means RX and said second resistive means is such that the reference voltage VREF is less than or equal to said silicon bandgap voltage.

14. The voltage control circuit of claim 11, further comprising a buffer circuit coupled to said junction REF.

15. The voltage control circuit of claim 14, wherein said buffer circuit comprises an operational amplifier.

16. A method of providing a bandgap reference circuit, said bandgap reference circuit comprising:

supplying a proportional to absolute temperature (PTAT) current source which provides a PTAT current, said PTAT current source comprising a first transistor connected between a voltage supply and a node REF;

supplying a proportional to base to emitter voltage (PTVBE) current source which provides a PTVBE current; said PTVBE current source comprising a second transistor;

connecting said second transistor between said voltage supply and said node REF;

operably controlling said PTAT current source by a first current source providing a current proportional to the ratio of the difference of the base to emitter voltage (ΔVBE) of a first transistor and a second transistor, said second transistor coupled to a first resistive means, in said first current source;

operably controlling said PTVBE current source by a second current source providing a current proportional to the ratio of a base to emitter voltage (VBE) of a third transistor and a second resistive means in said second current source;

coupling a resistive means RX between said node REF and a reference potential, thereby configuring said resistive means RX to receive said PTAT current and said PTVBE current and in accordance therewith provide a reference voltage VREF at said node REF which is essentially constant over temperature and which is proportional to a silicon bandgap voltage, said reference voltage VREF proportional to a said bandgap voltage of silicon (VBG) multiplied by the ratio of said resistive means RX and said second resistive means in said second current source; and operating said voltage control circuit with a supply voltage at least equal to the sum of said voltage VREF and a voltage drop across said PTAT current source.

17. The method of claim 16, wherein the ratio of said resistive means RX and said second resistive means is such that the reference voltage VREF is greater than or equal to said silicon bandgap voltage.

18. The method of claim 16, wherein the ratio of said resistive means RX and said second resistive means is such that the reference voltage VREF is less than or equal to said silicon bandgap voltage.

19. The method of claim 16, further comprising a buffer circuit coupled to said junction REF.

20. The method of claim 19, wherein said buffer circuit comprises an operational amplifier.

* * * * *